United States Patent [19]

Beuchat

[11] 4,300,255

[45] Nov. 17, 1981

[54] FOOT FLIPPER DEVICE

[76] Inventor: Georges Beuchat, 40 Rue de Cluny, Marseilles, France, 13008

[21] Appl. No.: 17,102

[22] Filed: Mar. 5, 1979

[30] Foreign Application Priority Data

Apr. 19, 1978 [FR] France ..... 78 12245

[51] Int. Cl.[3] ..... A63B 31/10; A63B 31/12

[52] U.S. Cl. ..... 9/309; D21/239; 9/305

[58] Field of Search ..... D21/239; 9/301, 304, 9/305, 306, 309

[56] References Cited

U.S. PATENT DOCUMENTS

| | | | |
|---|---|---|---|
| 3,256,540 | 6/1966 | Novelli | 9/309 |
| 3,302,223 | 2/1967 | Ciccotelli | 9/309 |
| 4,007,506 | 2/1977 | Rasmussen | 9/309 |
| 4,017,925 | 4/1977 | Shamlian | 9/309 |

*Primary Examiner*—Trygve M. Blix
*Assistant Examiner*—D. W. Keen
*Attorney, Agent, or Firm*—Sandler & Greenblum

[57] ABSTRACT

A foot flipper device for use on the leg of a swimmer. The foot flipper device comprises a shoe having front, heel and median portions; and a fin of variable inclination. The fin has a longitudinal cross-section of generally double curvature.

9 Claims, 3 Drawing Figures

FOOT FLIPPER DEVICE

BACKGROUND OF THE INVENTION

1. Field of the Invention

The invention relates to a foot flipper having a fin whose angle of inclination is variable relative to the flipper shoe.

2. Description of Prior Art

Conventional foot flipper devices comprise a shoe or foot pocket which is integral with the fin of the flipper so that when the angle of attack is propulsive at the beginning of the descending movement of the swimmer's leg, the angle of attack has the effect of reducing the propulsive effect of the fin along its front portion by virtue of the curvature assumed by this portion of the fin. By virtue of the reaction force exerted by the water, this portion of the fin remains only slightly propulsive during the descending movement of the swimmer's leg when the maximum propulsive effect is needed most.

SUMMARY OF THE INVENTION

It is an object of the invention to provide a device which overcomes the inconveniences and disadvantages encountered when using prior art devices.

It is a further object of the invention to provide a foot flipper device which serves to provide maximum propulsive effect throughout the entire descending movement, but which nevertheless facilitates the ascending movement of the swimmer's leg.

It is yet another object of the invention to provide a device which creates a propulsive effect throughout the ascending motion of the swimmer's leg equal to that which results during the descending movement thus resulting in a flipper which is highly effective yet easy to use.

These and other objects are fulfilled by means of the foot flipper device of the invention for use on the leg of a swimmer which comprises a shoe having front, heel and median portions; and a fin of variable inclination having a longitudinal cross-section of generally double curvature.

In a preferred embodiment of the invention the longitudinal cross-section of the fin of the flipper is made of a convex and concave section.

In a further preferred embodiment, the shoe of the flipper is attached along the convex portion of the fin and is integral with and adapted such that the position of the fin relative to the shoe is variable depending upon the direction of movement of the swimmer's leg when swimming.

BRIEF DESCRIPTION OF DRAWINGS

As shown in the annexed drawings, by way of example.

DESCRIPTION OF PREFERRED EMBODIMENTS

The foot flipper of the invention is designed such that the fin of the flipper assumes a position such that it extends in the direction of the tibia of the swimmer so as to make it possible for the second portion of the flipper to conserve the angle of attack so that it corresponds as closely as possible to the axis of the leg of the swimmer.

The device of the invention comprises a longitudinal cross-section having a double curvature, each of the curves having an opposite orientation. The front portion of the shoe is separate and rendered independent of the fin of the flipper arranged beneath it.

In a preferred embodiment of the invention the longitudinal cross-section of the fin of the flipper has a generally "S" shaped configuration composed of a convex and concave section. The convex and concave sections are oriented such that they are arranged opposite one another.

Figure 1:
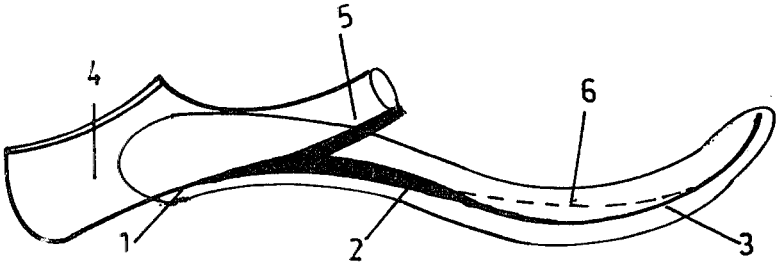
FIG. 1 is a cross-sectional view along the longitudinal axis of the foot flipper.
Figure 2:
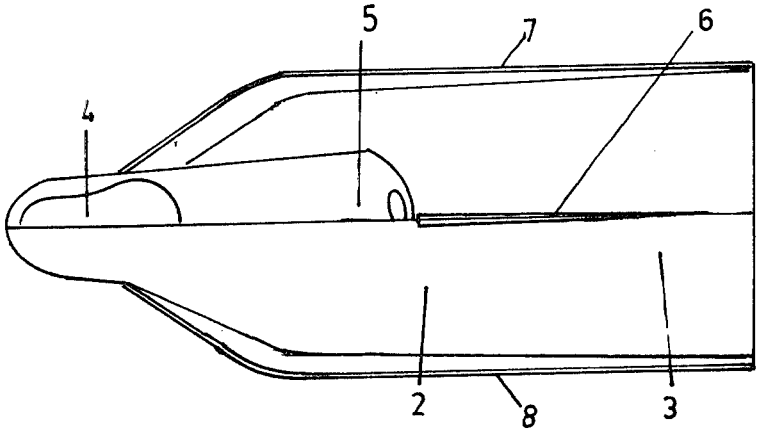
FIG. 2 is a top planar view of one embodiment of the foot flipper.

With reference to the drawings, FIGS. 1 and 2 illustrate the fin 1 which comprises a curve 2 which begins at the front median portion of the foot. This first curvature is adapted and arranged to make the fin adopt a position which extends along the axis of the tibia or leg of the swimmer.

As may be seen from FIG. 2, the second curve 3, arranged at the end is adapted to make it possible for the second portion of the flipper to conserve an angle of attack which is as close as possible to the axis of the leg of the swimmer during the propulsive effort exerted by the swimmer.

The front portion 5 of the shoe or foot pocket 4 is separate and independent of the fin. A reinforced joint section is thus formed at the point where the shoe meets the fin and the shoe is relatively free to pivot with respect to the fin.

The curved section 3 is bent in a manner such as to result in an angle of attack for the fin which is as close as possible to the axis of the leg and not that of the foot when the propulsive effort is being exerted. This considerably increases the propulsive effect by a rational use of the muscular effort while at the same time minimizing fatigue on the part of the swimmer.

When the swimmer exerts a propulsive effort, the reaction force exerted by the water tends to straighten the curved section 3 of the fin thus making it possible for the fin to arrange itself in a plane having an optimum angle of attack during the propulsive effort.

Conversely, during the ascending movement of the swimmer's legs, whose propulsive force was normally practically nil by virtue of the morphology of the leg of the swimmer and because of the bending or leaning movement of the foot due to the heel joint, the fin is nevertheless rendered operational in the foot flipper of the invention. In effect, the flipper is deflected or bent by virtue of the pushing effort of the water. This force will substantially flatten the fin assembly against the foot sole or shoe and results in a propulsive force due to the the shape of the fin.

Thus, it is by virtue of the combination of the double curvature the fin and the detachment of the foot shoe at the beginning of its front portion from the fin which result in the desired propulsive effects which are achieved.

A rib 6 serves to rigidify the axial portion of the flipper and as seen in FIGS. 1 and 2 the rib may traverse at least a portion of the concave portion of the fin.

The lateral edges of the flipper fin are reinforced by means of rims or borders 7 and 8 which extend above and below the fin so as to create grooves or passages which serve to create and direct streams and currents of water.

Figure 3:
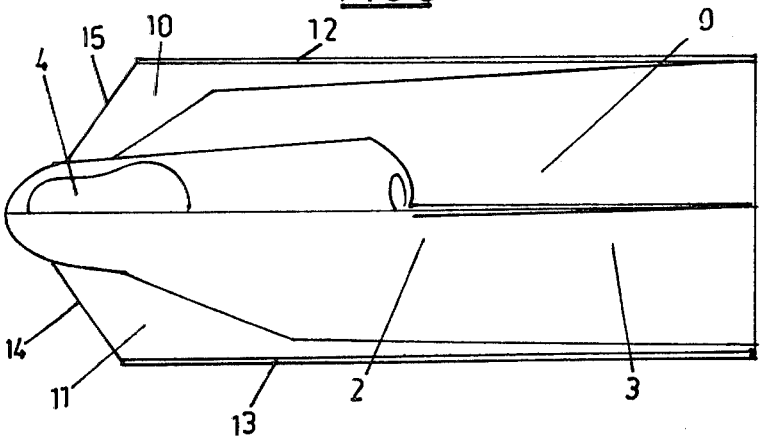
FIG. 3 is a top view of a second embodiment of the foot flipper shown in FIGS. 1 and 2.

In a second embodiment of the invention, shown in FIG. 3, it is possible to extend the usable surface of the fin 9 on both sides 10 and 11 of the foot shoe or pocket 4. This embodiment increases the propulsive effect of the flipper and facilitates the flow of the streams of water along the fin by eliminating edges 12 and 13 across the upper edges of the fin 14 and 15.

The flipper itself may be made of any of the conventional flexible materials generally used provided that the material used is capable of withstanding the forces generated in the course of use.

The invention has been described with respect to particular embodiments and the like. It is to be understood, however, that the invention is not limited with respect to the specific structure used and is to be construed as admitting of substitutions and modifications without departing from the scope of the invention as defined by the claims.

What is claimed is:

1. A flexible foot flipper device for use on the leg of a swimmer comprising:

(a) a shoe having front, heel, and median portions;

(b) a fin of variable inclination relative to said shoe, said shoe being integral with said fin and divergent therefrom at a point beneath said median portion, said fin having a longitudinal cross-section of generally double curvature, and being freely pivotable beneath said median portion of said shoe.

2. The foot flipper as defined by claim 1 wherein said fin comprises a concave section and a convex section.

3. The foot flipper as defined by claim 2 wherein said fin is adapted to be positioned as close as possible to the axis of the tibia of the swimmer when a downward effort is exerted by the foot of said swimmer to advance.

4. The foot flipper as defined by claim 3 wherein said convex section extends from one end of said fin and leads into said concave section.

5. The foot flipper as defined by claim 3 wherein said fin has two lateral edges and an axial section and said fin is ribbed along each of said edges and said axial section.

6. The foot flipper as defined by claim 5 wherein each of said ribs extends above and below said fin.

7. The foot flipper as defined by claim 6 wherein said fin comprises two rear edges extending until said heel section and two lateral edges, each of said lateral edges comprises a rib along its edge while each of said rear edges is not ribbed.

8. The foot flipper as defined by claim 3 wherein said fin extends to said heel portion of said shoe.

9. The foot flipper as defined by claim 8 wherein each of said ribs extends above and below said fin.

* * * * *

UNITED STATES PATENT AND TRADEMARK OFFICE

CERTIFICATE OF CORRECTION

PATENT NO. : 4,300,255

DATED : November 17, 1981

INVENTOR(S) : Georges BEAUCHAT

It is certified that error appears in the above—identified patent and that said Letters Patent is hereby corrected as shown below:

In the Specification, Column 1, line 47, --integral with and-- should be inserted after "is"; and
At line 48, "integral with and" should be deleted after "is".

Signed and Sealed this

*Sixteenth* Day of *February 1982*

[SEAL]

*Attest:*

GERALD J. MOSSINGHOFF

*Attesting Officer*

*Commissioner of Patents and Trademarks*